US007271771B2

(12) United States Patent
Usui et al.

(10) Patent No.: US 7,271,771 B2
(45) Date of Patent: Sep. 18, 2007

(54) FILM ANTENNA

(75) Inventors: Makoto Usui, Hitachi (JP); Yuuki Yamamoto, Hitachi (JP); Ryo Sato, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/067,014

(22) Filed: Feb. 28, 2005

(65) Prior Publication Data

US 2006/0077104 A1 Apr. 13, 2006

(30) Foreign Application Priority Data

Oct. 13, 2004 (JP) ..... 2004-298819

(51) Int. Cl.
*H01Q 1/24* (2006.01)

(52) U.S. Cl. ..... 343/702; 343/700 MS; 343/846; 343/829; 343/845

(58) Field of Classification Search ..... 343/700 MS, 343/702
See application file for complete search history.

(56) References Cited

U.S. PATENT DOCUMENTS 6,002,371 A * 12/1999 Mittler et al. ..... 343/702
6,297,776 B1 * 10/2001 Pankinaho ..... 343/700 MS
6,600,448 B2 * 7/2003 Ikegaya et al. ..... 343/700 MS
6,784,843 B2 * 8/2004 Onaka et al. ..... 343/700 MS
6,950,069 B2 * 9/2005 Gaucher et al. ..... 343/702
2002/0021250 A1 * 2/2002 Asano et al. ..... 343/702
2004/0070537 A1 * 4/2004 Kadambi et al. .... 343/700 MS
2004/0201528 A1 * 10/2004 Lee et al. ..... 343/702
2004/0233111 A1 * 11/2004 Desclos et al. ..... 343/700 MS

FOREIGN PATENT DOCUMENTS

JP 2002-099352 A 4/2002
JP 2002-232220 A 8/2002
JP 2003-008325 A 1/2003
JP 2003-152429 A 5/2003

* cited by examiner

*Primary Examiner*—Don Wong
*Assistant Examiner*—Binh V Ho
(74) *Attorney, Agent, or Firm*—Foley & Lardner LLP

(57) ABSTRACT

A film antenna whose antenna characteristics are unaffected by chassis is provided. A recessed groove portion 26 is formed in a ground portion 13 which is attached to a chassis 18. A first radiating element portion 14 is formed from a wall 26*a* on one side of the groove portion 26 to a wall 26*b* on the other side. A capacitive coupling piece portion 27 which is capacitively coupled via a specified gap g to the first radiating element portion 14 is formed on the wall 26*b* on the other side to thereby allow antenna characteristics to be unaffected by the chassis 18.

14 Claims, 3 Drawing Sheets

A: FILM ANTENNA
13: GROUND PORTION
14: FIRST RADIATING ELEMENT PORTION
15: SECOND RADIATING ELEMENT PORTION
16: SECOND LOOP ELEMENT PORTION

26: RECESSED GROOVE
27: CAPACITIVE COUPLING PIECE PORTION
30: POWER FEED PORTION

A: FILM ANTENNA
13: GROUND PORTION
14: FIRST RADIATING ELEMENT PORTION
15: SECOND RADIATING ELEMENT PORTION
16: SECOND LOOP ELEMENT PORTION

26: RECESSED GROOVE
27: CAPACITIVE COUPLING PIECE PORTION
30: POWER FEED PORTION

11: POLYIMIDE RESIN FILM
18: CHASSIS
21: BOSS
23: SCREW HOLE
24: SCREW
32: COAXIAL CABLE
35: NOTCH GROOVE

FILM ANTENNA

The present application is based on Japanese patent application No. 2004-298819, the entire contents of which are incorporated herein by reference.

BACKGROUND OF THE INVENTION

1. Field of the Invention

The present invention relates to a film antenna which is integrated into a chassis of a mobile terminal such as a notebook PC, or the like, and particularly, to a film antenna whose resonance frequency, even when it is fitted into a chassis formed of metal, can be preadjusted without being affected by the chassis.

2. Description of the Related Art

In mobile terminals such as notebook PCs, PDAs, etc., wireless LANs (IEEE 802.11a/b/g) have become increasingly common.

The standards of these wireless LANs are 802.11a which uses a band of 5 GHz, and 802.11b/g which uses a band of 2.4 GHz. As an antenna for wireless LANs, a planar antenna which is capable of dual-band oscillation in these bands of 2.4 GHz and 5 GHz has been demanded.

For example, as conventional planar antennae, Japanese patent application laid-open No. 2003-152429 discloses a planar antenna in which a ground portion and a radiating element portion are formed by the die-cutting of a lead frame, and Japanese patent application laid-open No. 2003-8325 discloses an antenna device in which an inverted-F antenna is formed of conductor films formed on both sides of an insulative substrate.

These antennae are housed by attaching them with a two-sided tape or the like to the back side of a peripheral frame of a mobile terminal display or the back side of a cover on a body side. However, since the display and body cover are provided with a metal chassis, there is the problem that, when an antenna is attached close to the metal chassis, it is affected by the metal chassis to cause a variation in resonance frequency. For this reason, to maintain antenna characteristics, an antenna is attached spaced a constant distance or greater apart from a metal chassis that is grounded, as shown in Japanese patent application laid-open Nos. 2002-99352 and 2002-232220. However, there is extreme difficulty in attaching the antenna to a narrow mobile terminal without affecting antenna characteristics, which, in practice, requires tuning by adjusting, for example, the length of the antenna element for each mobile terminal to which it is attached.

In particular, since a thin thickness has recently been required, and magnesium, aluminum, etc. have been used for chassis, there is difficulty in attaching the antenna spaced sufficiently apart from the metal chassis. Accordingly, there is the problem that, because a resonance frequency is significantly varied according to attachment position, antenna design must be performed taking account of chassis structure and attachment position, so that the antenna cannot be used for different models without modification.

Further, since antenna attachment is performed by using a two-sided tape, high-precision attachment to a fixed position cannot be ensured.

SUMMARY OF THE INVENTION

Accordingly, it is an object of the present invention to provide a film antenna whose antenna characteristics are unaffected by chassis.

In order to achieve the above object, a film antenna according to the present invention comprises a radiating element portion for constituting a monopole antenna; a ground portion for being formed to cover a part or whole of the radiating element portion and attached to a chassis; and a capacitive coupling piece portion for being formed in the ground portion to be capacitively coupled to the radiating element portion.

In the film antenna, on both sides of the ground portion, there are formed a boss hole which engages a boss formed in the chassis, and an attachment hole for screw-fastening to the chassis.

In the film antenna, a recessed groove portion is formed in the ground portion; a first radiating element portion is formed from a wall on one side of the groove portion to a wall on the other side; a capacitive coupling piece portion which is capacitively coupled via a specified gap to the first radiating element portion is formed on the wall on the other side; a reversed-L-shaped second radiating element portion which is shorter than the first radiating element portion is formed on the groove portion side of a base portion of the first radiating element portion; a power feed portion is formed in a base portion of the second radiating element portion; and a ground connection piece is formed in the groove portion of the ground portion opposite the power feed portion.

In the film antenna, a loop groove is formed in a rearward groove portion between the power feed portion and the ground connection piece; and a second loop radiating element portion is formed around the loop groove.

In the film antenna, the radiating element portion and the ground portion are formed by laminating both sides of a conductor plate with films of polyimide resin, or the like, followed by the die-cutting of the laminated conductor plate with a press.

According to the present invention, characteristics of the radiating element portion can be unaffected by the chassis by covering a part or whole of the radiating element portion with the ground portion, and by providing the capacitive coupling piece portion with a gap at a tip of the radiating element portion.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1A:
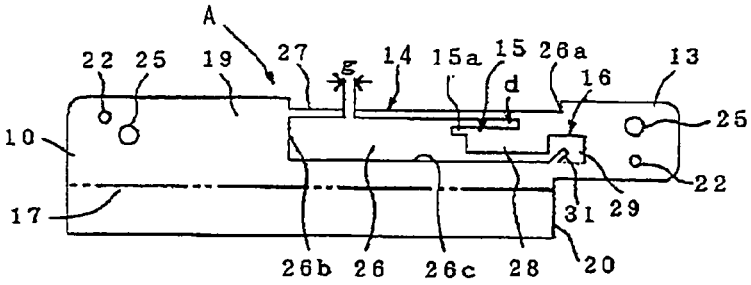
FIGS. 1A-1C are views illustrating one embodiment of the present invention.
Figure 1B:
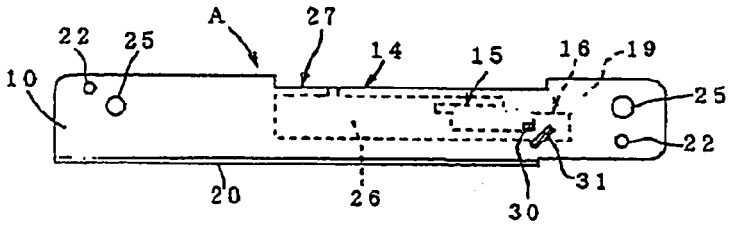
Figure 1C:
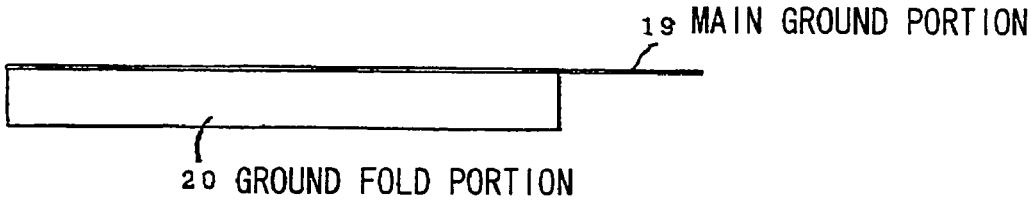
Figure 2:
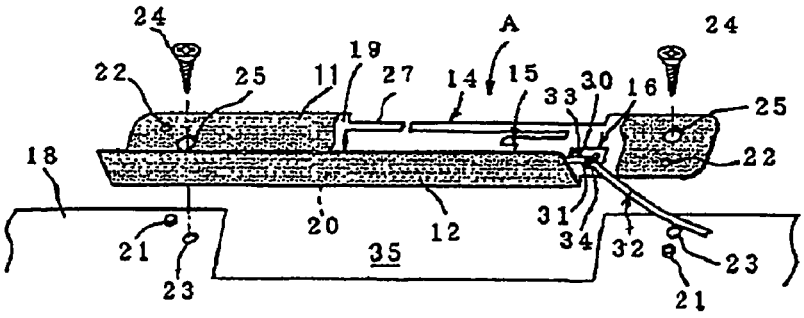
FIG. 2 is a perspective view illustrating a state where the film antenna of FIG. 1 is attached to a chassis.

FIGS. 1 and 2 illustrate one embodiment of a film antenna A. FIG. 1(*a*) shows a development of a state of die-cutting from a lead frame (a state with films peeled away) by a press. FIG. 1(*b*) shows a front view of the film antenna A. FIG. 1(*c*) shows a plan view of the film antenna A. FIG. 2 shows a perspective view of a state where the film antenna A is attached to a chassis.

In the figures, 10 is a conductor plate consisting of a copper plate. A ground portion 13, a first radiating element portion 14 for constituting a 2.4 GHz band monopole antenna, a second radiating element portion 15 for constituting a 5 GHz band monopole antenna, and a second loop element portion 16 for constituting a 5 GHz band loop antenna are formed by laminating both sides of the conductor plate 10 with films 11, 12 of polyimide resin, or the like, followed by die-cutting with a press, as shown in FIG. 1(*a*). A valley fold is formed along a fold line 17 to form the film antenna A.

The ground portion 13 comprises a rectangular main ground portion 19 which is attached to a chassis 18, and a ground fold portion 20 which is continuous with the main ground portion 19, and which is caused to rise from the fold line 17, as illustrated in FIG. 2. On both sides of the main ground portion 19, there are formed a boss hole 22 which engages a boss 21 of the chassis 18, and an attachment hole 25 for a screw 24 being fastened into a screw hole 23 of the chassis 18.

A recessed groove 26 defined by side walls 26*a*, 26*b* and a bottom wall 26*c* is formed in a middle portion of the main ground portion 19. A first radiating element portion 14 with a monopole antenna shape is formed from one side wall 26*a* of the groove 26 to the other side wall 26*b*. A capacitive coupling piece portion 27 for being capacitively coupled via a gap g to the tip of the first radiating element portion 14 is formed on the other side wall 26*b*.

A second radiating element portion 15 with a monopole antenna shape is formed on the groove portion 26 side of the first radiating element portion 14. This second radiating element portion 15 is formed in a reversed-L-shape from a base portion of the first radiating element portion 14, and its tip 15*a* is positioned within the groove portion 26. The second radiating element portion 15 is formed so as to be spaced a specified distance d apart from the first radiating element portion 14, and a stage portion 28 for adjusting radiating characteristics is formed on the way to the tip 15*a*.

A loop groove 29 and a second loop element portion 16 are formed on the rear end side of this stage portion 28 and by the bottom wall 26*c* of the groove portion 26.

A power feed portion 30 is formed in a rear end portion of the stage portion 28, and a ground connection piece 31 is formed on the bottom wall 26*c* positioned in the loop groove 29.

An inner conductor 33 of a coaxial cable 32 is soldered to the power feed portion 30, and an outer conductor 34 of the coaxial cable 32 is soldered to the ground connection piece 31.

The width of the first radiating element portion 14 is on the order of 1 mm, and the length of the first radiating element portion 14 from the power feed portion 30 is formed on the order of ¼ wavelength of 2.4 GHz. The width of the capacitive coupling piece portion 27 is on the order of 1 mm, and its length is on the order of 6 mm. The gap g between the first radiating element portion 14 and the capacitive coupling piece portion 27 is formed on the order of 1 mm.

The second radiating element portion 15 is formed so as to be spaced a distance d=1 mm or greater apart from the first radiating element portion 14, and is formed so that the length from the power feed portion 30 to the tip 15*a* is on the order of ¼ wavelength of 5 GHz. Further, the length of the loop groove 29 of the second loop element portion 16 from the power feed portion 30 to the ground connection piece 31 is formed so as to be on the order of ¼ wavelength of 5 GHz.

The attachment of this film antenna A to the chassis 18 is performed, as shown in FIG. 2, by first forming a notch groove 35 at an antenna attachment position of the chassis 18, forming a boss 21 and a screw hole 23 on both its sides, fitting the boss 21 into a boss hole 22 of the film antenna A, and then passing a screw 24 through an attachment hole 25 to screw it into the screw hole 23.

Figure 3:
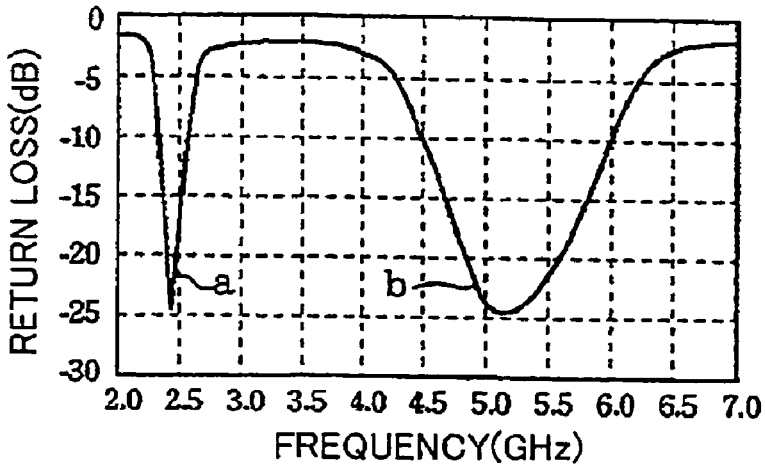
FIG. 3 is a graph showing characteristics of the film antenna of the present invention.

FIG. 3 shows characteristics of the film antenna of the present invention. In the figure, a shows characteristics of the first radiating element portion 14, and b shows characteristics of the second radiating element portion 15 and the second loop element portion 16.

Figure 4:
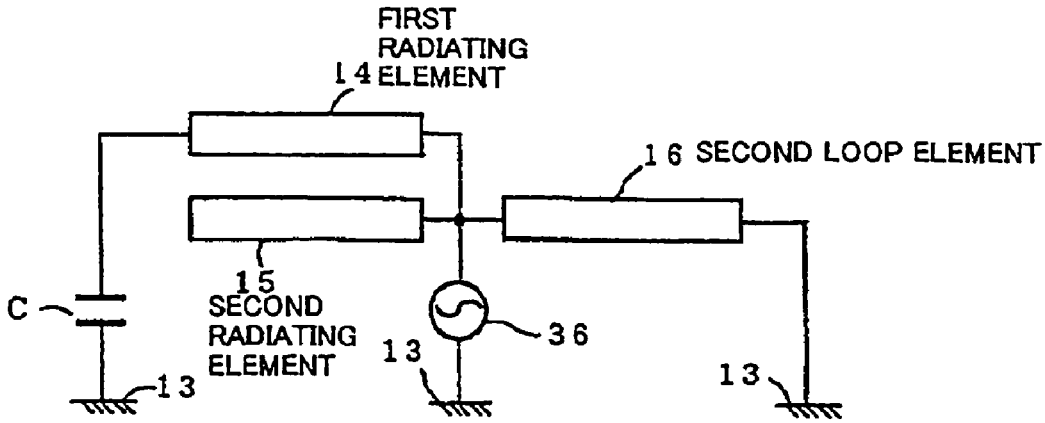
FIG. 4 is a diagram showing an equivalent circuit of the film antenna of the present invention.

FIG. 4 shows an equivalent circuit of the film antenna of the present invention, where a power supply 36 is connected to the power feed portion 30; the first radiating element portion 14 that is a monopole antenna is capacitively coupled to the ground portion 13 by a capacitor C comprising a gap; and the second radiating element portion 15 serves as a monopole antenna and the second loop element portion 16 serves as a loop antenna.

In the above embodiment, 2.4 GHz band resonance frequency oscillates from the first radiating element portion 14, and 5 GHz band resonance frequency oscillates from the second radiating element portion 15 and the second loop element portion 16. In this case, since the first radiating element portion 14, even when attached close to the metal chassis 18, is capacitively coupled to the capacitive coupling piece portion 27, preset characteristics of the first radiating element portion 14 can be maintained without being affected by the metal chassis 18. Also, since the second radiating element portion 15 has a shorter oscillation wavelength than that of the first radiating element portion 14 and is positioned within the groove portion 26 of the ground portion 13, its preset characteristics can likewise be maintained. Further, the second loop element portion 16 can broaden a 5 GHz band resonance wavelength range.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A film antenna, comprising:

a radiating element portion for constituting a monopole antenna;

a ground portion for being formed to cover a part or whole of said radiating element portion and attached to a chassis; and a capacitive coupling piece portion integrally formed in said ground portion to be capacitively coupled via a specified gap to said radiating element portion, said capacitive coupling piece portion extending from said ground portion towards said radiating element portion.

2. The film antenna according to claim 1, wherein, on both sides of said ground portion, there are formed a boss hole which engages a boss formed in said chassis, and an attachment hole for screw-fastening to said chassis.

3. A film antenna comprising:

a radiating element portion for constituting a monopole antenna;

a ground portion for being formed to cover a part or whole of said radiating element portion and attached to a chassis; and a capacitive coupling piece portion for being formed in said ground portion to be capacitively coupled to said radiating element portion, wherein:

a recessed groove portion is formed in said ground portion;

a first radiating element portion is formed from a wall on one side of said groove portion to a wall on the other side;

a capacitive coupling piece portion which is capacitively coupled via a specified gap to said first radiating element portion is formed on said wall on the other side;

a reversed-L-shaped second radiating element portion which is shorter than said first radiating element portion is formed on the groove portion side of a base portion of said first radiating element portion;

a power feed portion is formed in a base portion of said second radiating element portion; and a ground connection piece is formed in said groove portion of said ground portion opposite said power feed portion.

4. A film antenna comprising:

a radiating element portion for constituting a monopole antenna;

a ground portion for being formed to cover a part or whole of said radiating element portion and attached to a chassis; and a capacitive coupling piece portion for being formed in said ground portion to be capacitively coupled to said radiating element portion, wherein:

on both sides of said ground portion, there are formed a boss hole which engages a boss formed in said chassis, and an attachment hole for screw-fastening to said chassis, a recessed groove portion is formed in said ground portion;

a first radiating element portion is formed from a wall on one side of said groove portion to a wall on the other side;

a capacitive coupling piece portion which is capacitively coupled via a specified gap to said first radiating element portion is formed on said wall on the other side;

a reversed-L-shaped second radiating element portion which is shorter than said first radiating element portion is formed on the groove portion side of a base portion of said first radiating element portion;

a power feed portion is formed in a base portion of said second radiating element portion; and a ground connection piece is formed in said groove portion of said ground portion opposite said power feed portion.

5. The film antenna according to claim 3, wherein:

a loop groove is formed in a rearward groove portion between said power feed portion and said ground connection piece; and a second loop radiating element portion is formed around said loop groove.

6. The film antenna according to claim 4, wherein:

a loop groove is formed in a rearward groove portion between said power feed portion and said ground connection piece; and a second loop radiating element portion is formed around said loop groove.

7. The film antenna according to claim 1, wherein said radiating element portion and said ground portion are formed by laminating both sides of a conductor plate with films of polyimide resin, or the like, followed by the die-cutting of the laminated conductor plate with a press.

8. The film antenna according to claim 2, wherein said radiating element portion and said ground portion are formed by laminating both sides of a conductor plate with films of polyimide resin, or the like, followed by the die-cutting of the laminated conductor plate with a press.

9. The film antenna according to claim 3, wherein said radiating element portion and said ground portion are formed by laminating both sides of a conductor plate with films of polyimide resin, or the like, followed by the die-cutting of the laminated conductor plate with a press.

10. The film antenna according to claim 4, wherein said radiating element portion and said ground portion are formed by laminating both sides of a conductor plate with films of polyimide resin, or the like, followed by the die-cutting of the laminated conductor plate with a press.

11. The film antenna according to claim 5, wherein said radiating element portion and said ground portion are formed by laminating both sides of a conductor plate with films of polyimide resin, or the like, followed by the die-cutting of the laminated conductor plate with a press.

12. The film antenna according to claim 6, wherein said radiating element portion and said ground portion are formed by laminating both sides of a conductor plate with films of polyimide resin, or the like, followed by the die-cutting of the laminated conductor plate with a press.

13. The film antenna according to claim 1, wherein:

a recessed groove portion is formed in said ground portion, and said capacitive coupling piece portion is formed above said recessed groove portion.

14. The film antenna according to claim 13, wherein the capacitive coupling piece portion extends away from said ground portion in a direction towards said radiating element portion.

* * * * *